US005219083A

United States Patent [19]

Liebert et al.

[11] Patent Number: 5,219,083

[45] Date of Patent: Jun. 15, 1993

[54] STOPPER FOR REDUCTION OF PARTICULATE MATTER

[75] Inventors: Richard T. Liebert, Ballston Spa; Neil H. Brown, Nassau, both of N.Y.

[73] Assignee: Sterling Winthrop Inc., New York, N.Y.

[21] Appl. No.: 990,154

[22] Filed: Dec. 14, 1992

Related U.S. Application Data

[63] Continuation-in-part of Ser. No. 862,120, Apr. 2, 1992, abandoned.

[51] Int. Cl.[5] ..... B65D 39/00

[52] U.S. Cl. ..... 215/247; 215/364; 220/DIG. 19

[58] Field of Search ..... 215/247, 248, 249, 364; 220/DIG. 19

[56] References Cited

U.S. PATENT DOCUMENTS

| | | | |
|---|---|---|---|
| 2,459,304 | 1/1949 | Blank | 128/272 |
| 2,747,756 | 5/1956 | Hartop, Jr. et al. . | |
| 3,198,368 | 8/1965 | Kirkland et al. . | |
| 3,628,681 | 10/1969 | Schwartz . | |
| 3,760,969 | 9/1973 | Shimamoto et al. . | |
| 4,254,884 | 3/1981 | Maruyama | 215/232 |
| 4,635,807 | 1/1987 | Knapp | 215/247 |

*Primary Examiner*—Allan N. Shoap
*Assistant Examiner*—Paul A. Schwarz
*Attorney, Agent, or Firm*—Imre (Jim) Balogh; Arthur Rosenstein

[57] ABSTRACT

Disclosed is a stopper for a medical vial suitable for piercings by a spike without producing unacceptable amounts of particulate matter, comprising: a stopper body of an elastomeric material; and an abrasion resistant coating covering the top, central, piercable surface of the stopper.

1 Claim, 3 Drawing Sheets

STOPPER FOR REDUCTION OF PARTICULATE MATTER

This application is a continuation-in-part of application Ser. No. 07/862,120, filed Apr. 2, 1992, now abandoned.

BACKGROUND OF THE INVENTION

1. Field of the Invention

This invention relates to a stopper for a container and, more particularly, to an improved stopper for a container of parenteral solutions which is suitable for infusion spike penetration without producing unacceptable amounts of particulate matter.

2. Reported Developments

Stopper systems for vials, bottles and the like are made of materials that are resistant to chemicals and pharmaceuticals such as corrosive materials, reagents, parenteral solutions and solid formulations reconstitutable with a solvent prior to use. The most commonly used stopper system for such products has been glass or plastic bottles and vials equipped with rubber stoppers made of elastomeric materials. The system appears to provide for good hermetical seal, safe storage and easy access to the content through the elastomeric stopper via the use of an infusion spike when withdrawal of the content is desired. The elastomeric stopper used comprises an elastomeric base, such as natural or synthetic rubber and an inert coating covering at least some portions of the stopper. The coating used heretofor includes chlorobutyl rubber, polymeric fluorocarbon resins such as polytetrafluoroethylene (TEFLON) and various thermoplastic films. The coating is intended to insulate the elastomeric stopper base from the content of the container in order to prevent contact and possible chemical reactions therebetween.

One of the major concerns in all products, and especially pharmaceutical parenteral products, is the generation of particulate foreign matter which may contaminate such products. In order to eliminate macroscopic and microscopic particulates, elaborate measures have been taken to remove them, such as filtration of the product and special washing and drying of the stopper system components. These steps help assure that the products meet the requirements and guidelines of the pharmaceutical industry, such as compendia guidelines, when the products reach the point of use. However, at the point of use, such as in the case of a parenteral product, new particulate matter is frequently generated by the practitioner when the stopper is penetrated by a needle or spike of an infusion set or an infusion spike. During such penetration a combination of elastic and plastic deformation of the stopper target area increases the stopper contact surface with the infusion spike as it is pressed into the stopper. Typically, untreated elastomeric stoppers offer a high degree of resistance against the exterior surface of the spike as the spike is being pushed into the penetration area. Most frequently, when stopper fragments are generated, they are the result of the elastomeric portion of the stopper being abraded off the upper surface of the stopper as it conforms to the shape of the penetrating spike. The fragments are then transported into the interior of the vial as the spike rolls and drags the fragments during penetration.

In addition to the problem of particulate matter produced and carried into the vial during the spiking procedure, there are two other, although less frequently occurring, anomalies: stopper push-through into the vial and spike blow-out caused by residual elastic tension of the stopper against the spike which urges the spike outward.

The most common solution to these problems has been the application of silicone lubricant to the stopper and/or the spike to reduce the frictional drag between the stopper and the spike. While silicone does reduce particle generation from the spiking procedure, it also increases the risk of product contamination from its own composition.

Another approach proposed in the prior art to reduce the tendency of the stopper to generate particulate matter during manufacturing and storage is to coat the elastomeric core of the stopper with a thermoplastic film on the fluid contacting side thereof. We have found, however, that the use of such construction is less than satisfactory to solve the problem: the elastomeric particles generated by the spike during the piercing process are carried into the vials equipped with such stoppers.

The present invention addresses the need to eliminate or at least greatly reduce the particle generation from surface erosion of the stopper during spike penetration. In addition, the invention reduces the risk of the push-through and blow-out tendency by minimizing frictional drag and residual elastic tension during spike penetration. These advantages are achieved without the use of a lubricant, such as silicone oil, which could contaminate the product contained in the vial or bottle.

SUMMARY OF THE INVENTION

We have surprisingly found that if a non-reactive, inert, abrasion resistant coating is applied to the upper surface of an elastomeric stopper where spike penetration will take place, particle generation during spiking is all but eliminated and the tendency of push-through as well as blow-out of the spike is greatly reduced.

Accordingly, this invention provides a stopper for medical vials which is highly resistant to abrasion and formation of particulate materials upon spike penetration, comprising:

a stopper body of an elastomeric material having a cylindrical shape and top surface; and an abrasion resistant coating covering the center, spike-receiving portion of said top surface for spike or needle penetration of the stopper when withdrawal of fluid is desired.

In use, the coating on the top, spike-receiving surface of the stopper conforms to the deformation of the stopper caused by the spike penetration procedure. It appears that, upon piercing, the spike is not in contact with the elastomeric stopper body but only with the abrasion resistant coating thereby circumventing abrasion and eliminating the formation of elastomeric particulate materials.

DESCRIPTION OF THE PREFERRED EMBODIMENTS

Figure 1:
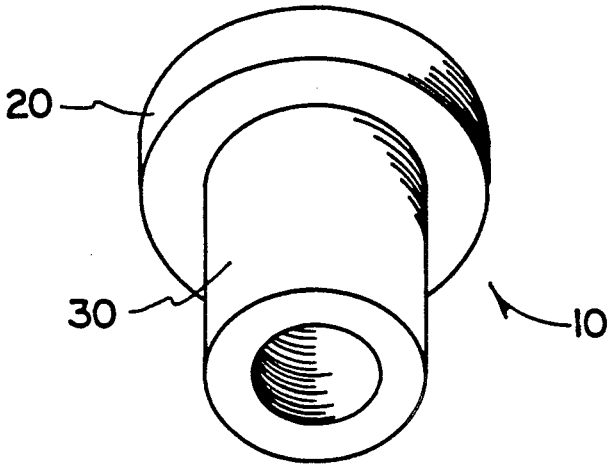
FIG. 1 is a perspective view of one embodiment of the stopper of the present invention.
Figure 2:
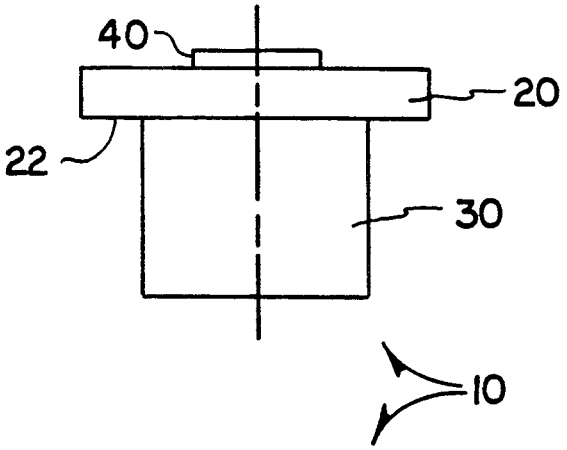
FIG. 2 is a plan view of the stopper shown in FIG. 1.
Figure 3:
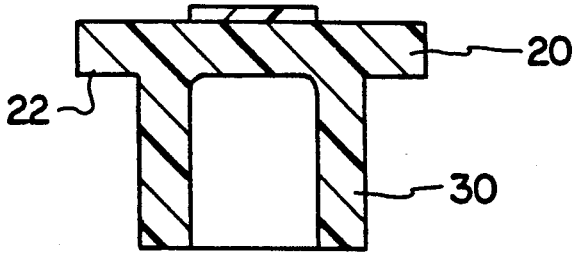
FIG. 3 is a cross sectional view of the stopper shown in FIG. 2 taken along the line a—a.

Referring to FIGS. 1, 2 and 3, numeral 10 shows one embodiment of the stopper of the present invention comprising: a head portion 20 and a leg portion 30. Head portion 20 comprises a flange 22 which is adapted to cover a corresponding planar, circular mouth portion of a medical vial, while leg portion 30 is adapted for insertion into the neck of the vial to tightly seal the content therein. Numeral 40 shows an abrasion resistant film mounted on the center part of the head portion 20 which serves as the piercing area for insertion and withdrawal of a spike or hypodermic needle.

Figure 4:
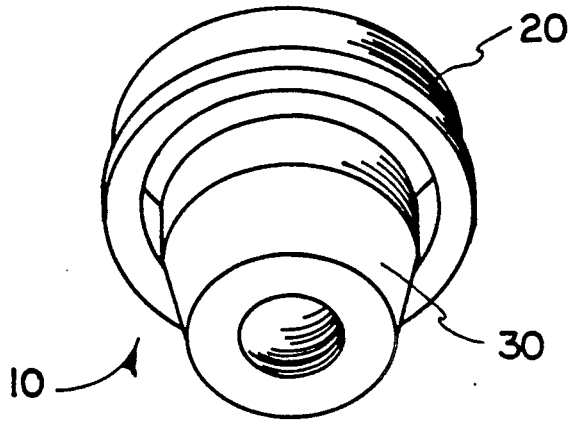
FIG. 4 is a perspective view of another embodiment of the stopper of the present invention.
Figure 5:
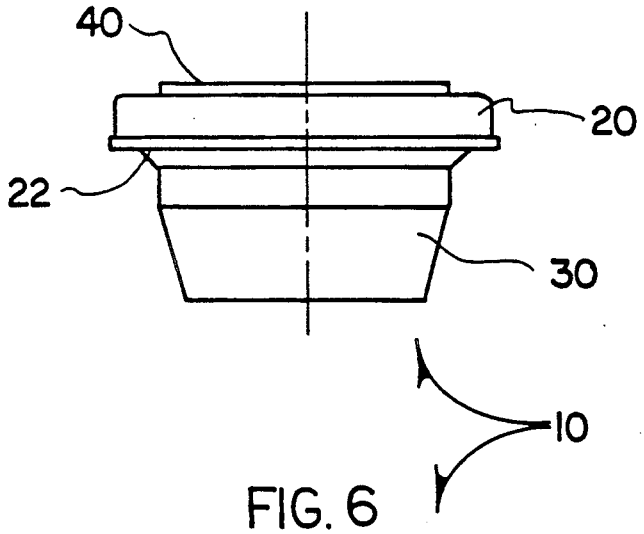
FIG. 5 is a plan view of the stopper shown in FIG. 4.
Figure 6:
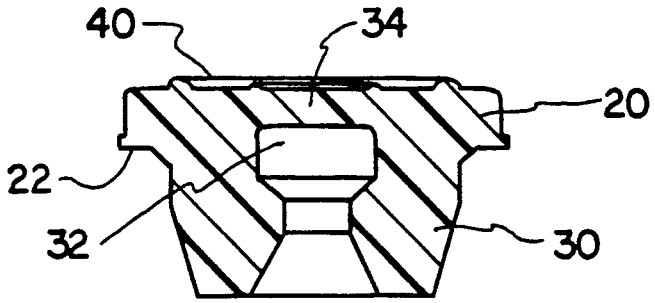
FIG. 6 is a cross sectional view of the stopper shown in FIG. 2 taken along the line b—b.

Referring to FIGS. 4, 5 and 6, numeral 10' shows another embodiment of the stopper of the present invention comprising: a head portion 20' and a leg portion 30'. Head portion 20' comprises a flange 22' which is adapted to cover a corresponding planar, circular mouth portion of a medical vial, while leg portion 30' is adapted for insertion into the neck of the vial to tightly seal the content therein. Numeral 40' shows an abrasion resistant film mounted on the top part of the head portion 20'. In this embodiment recess 32' extends toward the top surface of the head portion 20' forming a thin portion 34' in head portion 20' for facilitating piercing of the stopper by a spike.

Figure 7:
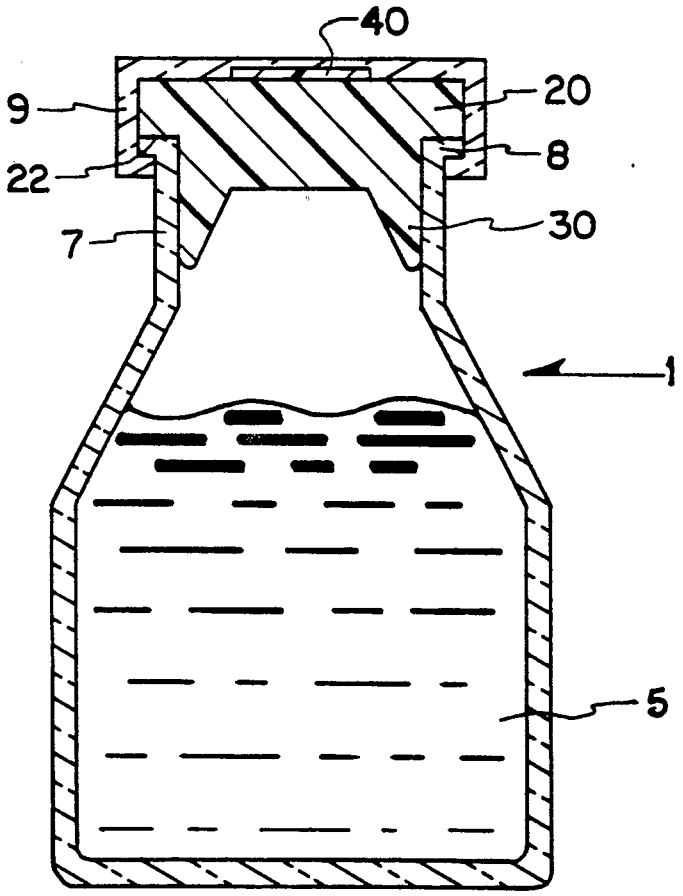
FIG. 7 is a cross section of a vial containing an injectable liquid closed with the stopper of the present invention.

FIG. 7 illustrates a stopper 10 having an abrasion resistant film 40 covering vial 1. Vial 1 containing an injectable fluid 5 is sealed by stopper (10 or 10') by inserting leg portion 30 of the stopper into the neck 7 of the vial 1. Flange portion 22 of head portion 20 tightly seals the mouth 8 of vial 1. A thin metal foil 9 is crimped over head portion 20 and flange portion 22 of stopper (10 or 10') to tightly seal and securely hold the stopper in vial 1.

Materials of Construction

The elastomeric material of the stopper body must be a fluid impervious, resilient, and inert material without leachable additives therein in order to prevent any alteration of the product contained in the vial. It may be of a single component or a blend of components. Examples of materials include synthetic or natural rubber, such as butyl rubber, isoprene rubber, butadiene rubber, silicone rubber, halogenated rubber, ethylene propylene therpolymer and the like. Specific examples of a synthetic elastomeric rubber include the $CH_2CF_2$—$C_3F_6(C_3F_5H)$ and the $C_2F_4$—$C_2F_3OCF_3$ series of elastomers made by du Pont under the trade names of VITON® and CARLEZ®; the fluorosilicone rubbers, such as those made by Dow Corning under the name of SILASTIC®; and polyisobutylenes, such as VISTANEX MML-100 and MML-140; and halogenated butyl rubber, such as CHLOROBUTYL 1066, made by Exxon Chemical Company.

These or other suitable elastomers may be made into the desired stopper configuration by known methods. Such methods conventionally include the use of a curing agent, a stabilizer and a filler and comprise a primary and secondary curing step at elevated temperatures.

The abrasion resistant coating for covering the top, spike-receiving portion of the stopper thereof may be: a polyolefin, such a polypropylene and polymethylpentene; a polyvinyl, such as polystyrene, polyvinyl acetate (PVA), polyvinyl chloride (PVC), polyvinylidene chloride (PVDC), a copolymer of polyvinyl chloride (PVC) and polyvinylidene chloride (PVDC), polyvinyl fluoride, polyvinylidene fluoride, polychlorotrifluoroethylene and polytetrafluoroethylene (TEFLON); an ether, such a polymethylene oxide, polyphenylene oxide and polyphenylene sulphone; an ester, such as polyethylene terephthalate (PET), polycarbonate and copolyesters; an ester, such as polycaprolactam (Nylon 6), polyhexamethylene adipamide (Nylon 66) and polyundecanoamide (Nylon 11).

The abrasion resistant coating covering the center, piercable portion of the top surface of the stopper is preferably polytetrafluoroethylene sold under the trade name TEFLON by duPont. The coating thickness will be in the range of about 0.002 to 1.0 mm, and preferably about 0.02 to 0.5 mm. The coating may be applied or bonded to the stopper body in any suitable manner known in the art, such as, but not limited to, by the use of adhesives, solvents, spray applications, radio waves, infrared, microwaves, ultrasonics and heat.

The stopper of the present invention comprising an elastomeric material and a TEFLON coating on the top, center portion thereof was tested against another stopper of the same elastomeric material but without the TEFLON coating thereon (control).

Vials were capped with the stoppers. Each stopper was pierced with a spike and then the spike was removed. The vials were examined for the presence of elastomeric particles caused by the piercing. The result of the spiking is shown in Table 1.

TABLE 1

| Stopper | No. of Samples | Mean Particle Count |
|---|---|---|
| Elastomeric Body (Control) | 25 | 15.4 |
| Elastomeric Body w/ TEFLON coating | 25 | 0.6 |

In another experiment, the stopper of the present invention comprising an elastomeric material and a coating of polyvinyl chloride (PVC), polyvinylidine chloride (PVDC), copolyester ether (EDCL) or polyolefin/thermoplastic elastomer (KRATON), covering the top, spike-receiving portion of the stopper was tested against another stopper of the same elastomeric material (control) but without the coating thereon.

Vials were capped with the stoppers. Each stopper was pierced with a spike and the spike was removed. The vials were examined for the presence of elastomeric particles caused by the piercing. The result of the syringe is shown in Table 2.

TABLE 2

| Stopper | No. of Samples | Mean Particle Count |
|---|---|---|
| Elastomeric Body (Control) | 30 | 10.33 |
| Elastomeric Body w/PVC Coating | 30 | 4.67 |
| Elastomeric Body w/PVDV Coating | 30 | 4.67 |
| Elastomeric Body w/ECDL Coating | 30 | 2.33 |
| Elastomeric Body w/KRATON Coating | 30 | 4.33 |

The present invention has been described in connection with the preferred embodiments shown in the drawings, it is to be noted, however, that various changes and modifications are apparent to those skilled in the art.

What is claimed is:

1. An abrasion resistant stopper for a medical vial containing a fluid therein consisting of:

a stopper body of an elastomeric material having a head portion and a fluid contacting leg portion; said leg portion being adapted to be inserted into said medical vial to hermetically seal said fluid therein; said head portion having a bottom, fluid-contacting surface and a top having a central piercable portion, said central portion having a spike-receiving surface, said spike-receiving surface being coated with a single abrasion resistant film, said film being adapted to conform to the jagged, uneven edges of a hole created by a spike upon said spike piercing the stopper and providing a barrier between the spike and elastomeric material, thereby preventing mechanical contact between the spike and elastomeric material and the consequent generation of elastomeric particles, said abrasion-resistant film being selected from the group consisting of polystyrene, polyvinyl acetate, polyvinyl chloride, polyvinylidene chloride, copolymer of polyvinyl chloride and polyvinylidine chloride, polyvinyl fluoride, polyvinylidene fluoride, polychlorotetrafluoroethane, polytetrafluoroethane, polymethylene oxide, polyphenylene oxide, polyphenylene sulfone, polyethylene terphthalate, polycarbonate, copolyesters and polycaprolactam.

* * * * *

UNITED STATES PATENT AND TRADEMARK OFFICE

CERTIFICATE OF CORRECTION

PATENT NO. : 5,219,083

DATED : June 15, 1993

INVENTOR(S) : Richard T. Liebert and Neil H. Brown

It is certified that error appears in the above-indentified patent and that said Letters Patent is hereby corrected as shown below:

Column 6, lines 9 and 10, substitute "polycholorotrifluoroethylene" for "polycholorotetrafluoroethane".

Column 6, line 10, substitute "polytetrafluoroethylene" for "polytetrafluoroethane".

Column 6, line 12, substitute "polyethylene terephthalate" for "polyethylene terphthalate"

Signed and Sealed this

Fourteenth Day of May, 1996

Bruce Lehman

*Attest:*

BRUCE LEHMAN

*Attesting Officer*

*Commissioner of Patents and Trademarks*